US005675321A

United States Patent [19]

McBride

[11] Patent Number: 5,675,321

[45] Date of Patent: Oct. 7, 1997

[54] PERSONAL COMPUTER SECURITY SYSTEM

[76] Inventor: Randall C. McBride, 930 County Rd. 1A, Montrose, Colo. 81401

[21] Appl. No.: 563,988

[22] Filed: Nov. 29, 1995

[51] Int. Cl.[6] ..... G08B 13/14

[52] U.S. Cl. ..... 340/568; 340/517; 364/286.5; 364/DIG. 1; 380/4; 395/491

[58] Field of Search ..... 340/568, 571, 340/652, 687, 522, 529, 511, 825.31, 825.32, 825.34; 395/186, 188.01, 726, 427, 491; 364/222.5, 286.4, 286.5, 969.2, 969.4; 380/4, 25; 235/382, 382.5; 379/377, 95

[56] References Cited

U.S. PATENT DOCUMENTS

| | | | |
|---|---|---|---|
| 3,890,601 | 6/1975 | Pietrolewicz | 395/491 |
| 4,494,114 | 1/1985 | Kaish | 340/825.31 |
| 4,654,640 | 3/1987 | Carll et al. | 340/568 |
| 5,012,514 | 4/1991 | Renton | 380/4 |
| 5,059,948 | 10/1991 | Desmeules | 340/568 |
| 5,140,631 | 8/1992 | Stahl | 379/377 |
| 5,231,375 | 7/1993 | Sanders et al. | 340/568 |
| 5,254,973 | 10/1993 | Gilmore, II | 340/547 |
| 5,375,243 | 12/1994 | Parzych et al. | 395/188.01 |
| 5,406,260 | 4/1995 | Cummings et al. | 340/568 |
| 5,574,786 | 11/1996 | Dayan et al. | 380/4 |

*Primary Examiner*—Thomas Mullen
*Attorney, Agent, or Firm*—Duft, Graziano & Forest, P.C.

[57] ABSTRACT

The personal computer security apparatus of the present invention provides a security architecture embedded within the personal computer itself to provide a practical level of security to thereby discourage theft of the personal computer. Apparatus are provided to monitor the continuity of the connection to the telephone line to which the personal computer is connected. Loss of voltage continuity on the telephone line for greater than a predetermined period of time is indicative of an individual unplugging the personal computer from the phone jack in order to enable the person to move the personal computer. Motion sensor switches are optionally provided to detect physical movement of the personal computer in excess of a predetermined minimum allowable range of motion. The apparatus generates an audible alarm in response to the detection of a person's attempt to relocate the personal computer without properly disabling the security software via the keyboard. In addition to the audible alarm that is generated, software resident on the personal computer can obliterate the data stored on the hard disk by reformatting the hard drive to thereby thwart a thief from having access to the data stored on the personal computer.

20 Claims, 2 Drawing Sheets

PERSONAL COMPUTER SECURITY SYSTEM

FIELD OF THE INVENTION

This invention relates to personal computers and, in particular, to apparatus that detects unauthorized movement of the personal computer and generates an alarm in response thereto.

PROBLEM

It is a problem in the field of personal computers to provide some form of security to deter theft of this apparatus. The term "personal computer" encompasses the range of stand-alone portable computing devices designed to provide a user with sophisticated data processing capability. Personal computers range from personal assistants/portable laptop devices to substantial size workstations which can be operated in an independent stand-alone mode or can be interconnected with other computers via a data communication medium, for example a local area network, wireless communication medium or the public switched communication network, by way of a modem. In all these cases, the personal computer represents a significant financial investment as well as a critical repository of data for the owner of the personal computer. It is not uncommon, however, for a personal computer to remain unattended for periods of time in the workplace or in the home environment in locations that enable a person to make off with the personal computer, since it is essentially a portable device.

In addition to the financial loss occasioned by the theft of a personal computer, the loss of the data contained thereon can represent a devastating blow to the owner of the personal computer. The data that was stored in the memory of the personal computer is retrievable if backup tapes are used to store duplicate copies of the data, but the ancillary problem of having this critical data in the hands of a dishonest person cannot be overcome. In particular, many personal computers contain a significant amount of personal financial information which enables a person reading this data to access the user's assets by way of the confidential information stored on the personal computer. While there are devices which address data security specifically, there presently is no personal computer security device that adequately addresses the issue of personal computer security other than some primitive mechanical computer locks that physically secure the personal computer to a desk or a workstation. In the case of a portable or laptop personal computer, the use of these lock devices is typically inapplicable.

SOLUTION

The personal computer security apparatus of the present invention provides a security architecture embedded within the personal computer itself to provide a practical level of security to thereby discourage theft of the personal computer. This apparatus addresses the issue of personal computer security from the perspective that there are a number of potential scenarios that must be addressed to ensure that an adequate level of security is provided to the user. The security apparatus must detect unauthorized movement of the personal computer and, in turn, generate an alarm and optionally activate data security measures in response to the detection of unauthorized movement. This security apparatus must be capable of being disabled by the authorized user so that the user can relocate the personal computer when necessary. To achieve this level of security, a hierarchical arrangement of security apparatus is provided which apparatus are cooperatively operative to both accurately detect unauthorized movement of the personal computer and produce remedial actions in response thereto.

Apparatus are provided which can be part of a modem device in the personal computer to monitor the continuity of the connection to the telephone line to which the personal computer is connected. Loss of voltage continuity on the telephone line for greater than a predetermined period of time is indicative of an individual unplugging the personal computer from the phone jack in order to enable the person to move the personal computer. Furthermore, motion sensor switches are optionally provided to detect physical movement of the personal computer in excess of a predetermined minimum allowable range of motion. Furthermore, the continuity of line voltage can optionally be monitored to note when the personal computer is unplugged from the source of AC power. Other sources of a reference signal can be used to enable the security system to determine whether the personal computer is being moved by an unauthorized individual. The apparatus of the present invention can be battery powered to operate various aspects of the device including, but not limited to, generating an audible alarm in response to the detection of a person's attempt to relocate the personal computer without properly disabling the security software via the keyboard. In addition to the audible alarm that is generated, software resident on the personal computer can obliterate the data stored on the hard disk by reformatting the hard drive to thereby thwart a thief from having access to the data stored on the personal computer. In this manner, a user can with ease relocate the personal computer by simply accessing the security software via the keyboard and providing the necessary password authorization to disable the security apparatus until the personal computer has been relocated to another site and the security apparatus re-enabled. Absent this action by the user, any attempts to move the personal computer outside the predetermined set of parameters results in the automatic generation of the alarm and any other security measures that are enabled by the user.

DETAILED DESCRIPTION

Figure 1:
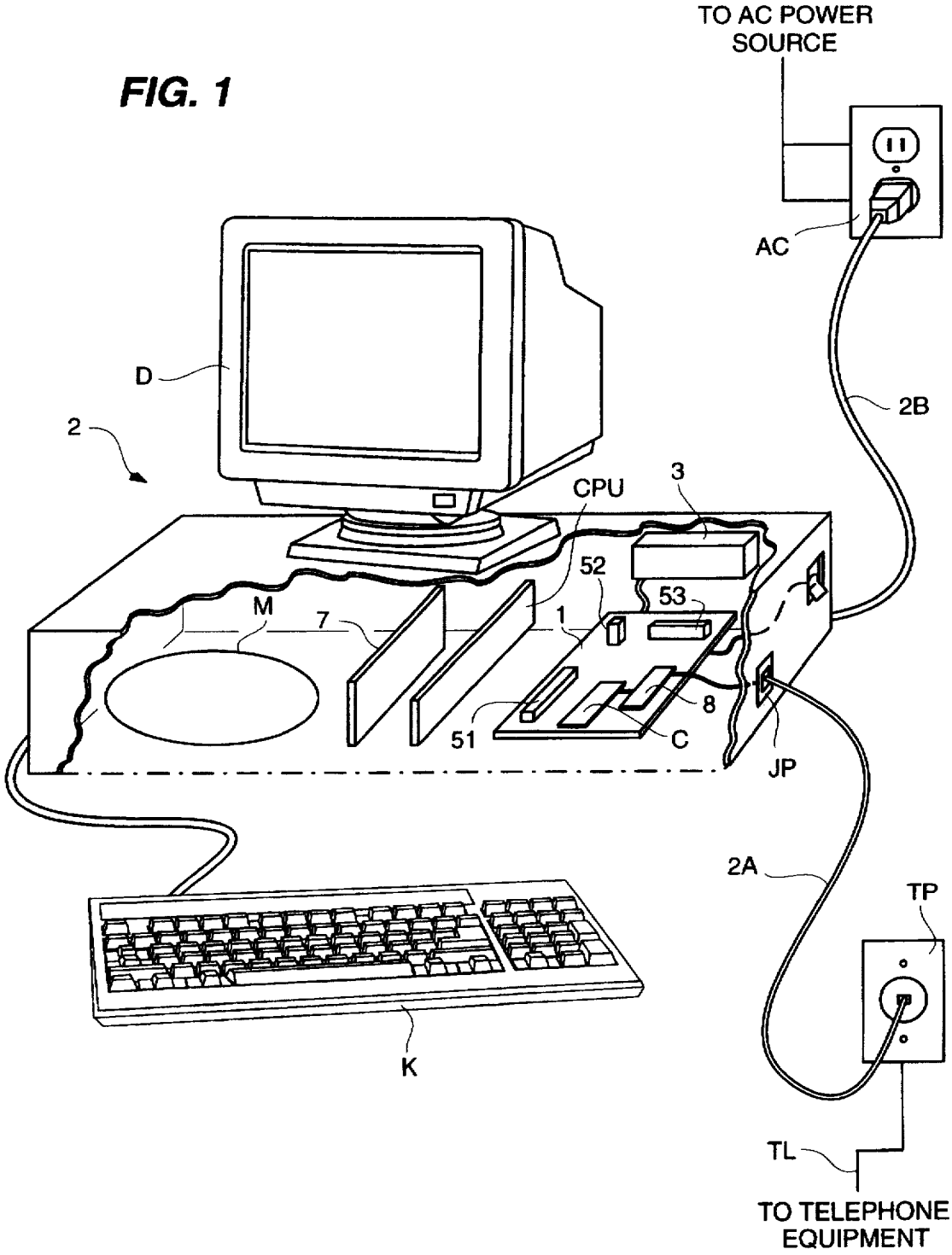
FIG. 1 illustrates in block diagram form the overall architecture of the security apparatus of the present invention as installed in a personal computer.

FIG. 1 illustrates in block diagram form the overall architecture of the security apparatus of the present invention as it is installed in a typical personal computer. The vast majority of personal computers are located at an individual's desk or workstation whether in an office or home environment. The personal computer typically includes a power cord that is plugged into a source of AC power. In addition, many personal computers are equipped with a built-in or stand alone modem device (including PCMCIA connected devices) to enable the user to communicate with other computers or information services via data communication facilities. The security apparatus of the present invention is illustrated as embodied as an integral part of the personal computer, although the specific apparatus used for security purposes can be a separate circuit board installed in any personal computer with its accompanying control software.

For the personal computer security system to be practicable, it must enable the authorized user to operate the personal computer without significant impediment, otherwise, the authorized user typically disables the security apparatus due to its inconvenience. Likewise the security apparatus must be relatively effective, accurately sensing a situation which truly represents an attempt at theft in a manner which cannot be easily thwarted. Finally, the security apparatus must be cost effective, in that it cannot be expensive to install or operate. Presently, there is no personal computer security apparatus which satisfies these requirements and personal computers are generally unprotected, other than being resident in a premises which itself may deter theft. However, there are many instances, including office environments, where the personal computer is an easy target for theft. The loss of the personal computer can be financially catastrophic, in terms of the equipment itself as well as additional factors comprising the loss of work continuity, and the temporal cost to reconstruct the lost data contained on the personal computer. The data resident on the personal computer may also be of great value to the user, in terms of sensitive business information or personal financial information which can be used by the thief to cause significant loss to the user far beyond the cost of the personal computer loss.

Security Apparatus Philosophy

The above-noted requirements can be met by the personal computer security apparatus 1 of the present invention, which implements an effective level of security in a simple manner. The preferred embodiment of the invention (FIG. 1 ) discloses a security system 1 which can be customized by the user to operate in harmony with the operating environment of the personal computer 2 and which can also provide both a hierarchical set of security measures as well as a plurality of security devices. The combined apparatus represents a highly effective response to the possibility of theft of the personal computer 2.

The security system 1 is preferably battery 3 powered to enable its operation even if the personal computer 2 is disconnected from the normal source of AC power. The batteries can be maintained in a charged state by the voltage present on the telephone line, the standard battery pack in a laptop computer, the AC line, or any other source of power. The security system 1 "anchors" the personal computer 2 by monitoring at least one relatively immutable reference present in the ambient environment. The immutable reference represents some measurable phenomena that is present at all times in the locale of the personal computer 2, and which can be used to determine the movement of the personal computer 2 from that locale to an extent greater than predetermined limits. The variance of the immutable reference from a nominal value by greater than a predetermined amount triggers the security system 1 to determine that an anomaly is present. For example, it is uncommon for a personal computer 2 to be situated on a desk and be out of reach of a telephone jack TP. The preferred embodiment of the security apparatus 1 of the present invention takes advantage of this fortuitous situation by making use of the telephone line TL as the immutable reference and an indicator of lack of movement of the personal computer 2. The DC bias signals present on the telephone line TL represent a relatively immutable reference, since the local telephone operating company does not solely rely on the commercially generated AC power to operate the telephone equipment, but provides its own electricity generation capability in the event that the local power company experiences a power failure. Thus, the DC bias voltage present on the telephone line TL remains present largely without interruption at all times. Furthermore, the "validity" of the voltage present on the telephone line TL can be simply confirmed by connecting a low impedance across the tip and ring conductors of the telephone line TL, which causes a current to flow through the tip and ring conductors. The telephone company switching equipment senses this current flow and applies dial tone to the tip and ring conductors, which can be detected by the security system 1 as a confirmation that the personal computer 2 is presently connected to the telephone line TL and that a bogus source of telephone line voltage has not been substituted for the telephone line TL. Thus, the telephone line TL functions as a security link to "tether" the personal computer 2 to a specific location, which security link is not susceptible of tampering without such tampering being detectible.

Another source of unauthorized movement detection can be the use of motion sensors 51–53 mounted within the personal computer 2 to detect a significant degree of movement of the personal computer 2. The signals generated by the motion sensors 51–53 can be used in conjunction with the telephone TL line monitoring apparatus, to confirm the fact that the personal computer 2 is being relocated. Similarly, the loss of AC power to the personal computer 2 is another indicia that the personal computer 2 is being relocated. A further source of a reference signal is the availability of cellular communications, wherein the security system 1 coordinates a determination of its position with respect the predetermined "cell site" in which the personal computer 2 is located. If the computer system 2 is moved outside of the known cell site, this action constitutes a security violation. Thus, there are a number of readily available sources of information that can be used by the logic present in the security system 1 to ascertain, with a fairly high level of accuracy, that the personal computer 2 is being moved a distance greater than a predetermined permissible amount.

The response of the security system 1 to an attempt to move the personal computer 2 can be multi-faceted. The response can be an escalating response, first prompting the user to indicate authorization to move the personal computer 2, followed, if no valid authorization is provided within an allotted response time, by punitive responses to protect the personal computer 2 and/or the data stored therein. The responses can also be customized by the user, from a list of possible responses provided by the security system 1. The punitive responses can include, but are not limited to: audible alarms, CPU disablement, data erasure.

Security System Architecture

FIG. 1 illustrates in block diagram form the overall architecture of the personal computer security system 1 as well as the environment in which it operates. In particular, the basic equipment that the personal computer security system 1 is designed to protect comprises a personal computer 2 (any portable computing apparatus) which is often connected via its power cord 2B or an adaptor to a source of AC power, typically the local AC outlet or to an internal battery pack power source. The personal computer 2 comprises a central processing unit CPU which is connected to a plurality of additional circuitry via system busses (not shown), one of which is typically a non-volatile memory M, such as a hard disk drive. The user interface to the central processing unit CPU typically comprises a display D for presenting visual images to the user and at least one user input device, such as a keyboard K, mouse (not shown) or stylus (not shown). In addition, the personal computer 2 is shown connected via a modular telephone cord 2A to a telephone line TL. Contained within the personal computer 2 is the security system 1, which includes a source of battery power 3 as well as optional motion sensors 51–53. If the personal computer 2 does not include a modem device 7, the security system 1 can be equipped with the telephone line monitoring apparatus 8, some portion of which is normally incorporated into the standard modem device 7. In fact, one option is to incorporate the security system 1, at least in part, into a modem device 7 as an added feature of the modem device 7. (The PC bus interconnection to the CPU, memory M, modem 7 and security system 1 is not shown for simplicity of the drawing.)

The security system 1 is physically installed within the personal computer 2, typically as an additional circuit board in one of the provided option circuit board slots (including PCMCIA slots). Security system 1 is shown mounted in a horizontal orientation to simplify the representation of the elements that comprise security system 1. The security system 1 in the preferred embodiment of FIG. 1 is connected to the telephone port JP of the personal computer 2 to monitor the telephone line 2A which is connected thereto. The operation of the personal computer security system 1 illustrated in FIG. 1 is described in flow diagram form in FIG. 2. The system configuration shown in FIG. 1 is, as described above, in the context of the telephone line being the immutable source, although any other immutable source can be used. The personal computer 2 is connected to a telephone line 2B via the telephone port JP, which is standard on the personal computer 2. The security system 1 includes logic circuitry C which regulates its operation. The interconnection of the various elements that comprise security system 1 is via conductors (not all shown) present on the circuit board on which these elements are mounted.

In operation, the telephone line monitoring apparatus 8 comprises circuitry which monitors the ambient DC voltage which is present on telephone line TL, which appearance is via a standard wall mounted telephone jack TP. The telephone line monitoring apparatus 8 outputs a logic signal indicative of the presence or absence of this nominal DC bias voltage on the telephone line TL. The nominal –48 volt bias can vary as a function of the length of the subscriber loop, the operation of the switching equipment which serves telephone line TL, as well as a function of numerous other variables well-known in telephony. Therefore, the telephone line monitoring apparatus 8 does not change its logic state until the voltage present on the telephone line TL varies by more than a predetermined amount or permitted states, such as battery reversal, from the nominal value. Thus, at step 201, the security system 1 continually monitors (typically on a polled basis as evidenced by step 202) the telephone line TL via telephone line monitoring apparatus 8.

If the voltage present on the telephone line TL does not vary by greater than the predetermined amount (or from permitted normal states), the security system control circuit C at step 203 can optionally, on a periodic basis, verify the validity of the voltage present on the telephone line TL. One way this is accomplished is by activating the off-hook circuit that is part of the telephone line monitoring apparatus 8 at step 203A to close the loop to the switching system which serves the telephone line TL. In response to the off-hook condition present on telephone line TL, the switching equipment places dial tone on the telephone line TL. At step 203B, a dial tone detector that is part of the telephone line monitoring apparatus 8 at step 203A identifies the presence of dial tone on telephone line TL and processing proceeds back to step 201 as part of the standard monitoring loop. If dial tone is not present after a predetermined period of time, the dial tone detector times out and processing advances to step 204 where the failure of dial tone reflects that an abnormal condition is present on telephone line TL. Alternatively, at step 202 if the voltage present on the telephone line TL varies by greater than the predetermined amount or differs from the permitted states, the security system control circuit C at step 202 determines that an abnormal condition is present on telephone line TL and processing advances to step 204. Optionally, at step 202 if the anomaly is detected, the control circuit C can activate step 203 to verify that the detected anomaly is indeed a security violation.

The control circuit C at step 204 can optionally initiate a timing function to ensure that the anomaly detected on telephone line TL is not simply a transient. If the anomaly persists for more than the time duration of the timing function, the control circuit C advances its operation to step 205 where additional confirmation steps can be taken to ensure that a false indication is not generated.

The control circuit C at step 205 can optionally confirm the presence of the anomaly being a result of unauthorized movement of the personal computer 2 by checking the status of other sensors contained in security system 1. These additional sensors can include motion sensors 51–53 which, in their normal state, produce a fixed signal indicative of the proper baseline position of the sensors 51–53, and by inference the personal computer 2, being located in a rest position. Once the personal computer 2 is moved by greater than a predetermined amount, one or more of the motion sensors 51–53 are activated and the output signals generated by one or more of the motion sensors 51–53 change state to indicate the movement of personal computer 2. A plurality of motion sensors 51–53 are typically used for this application, with one being positioned in each of a different one of a plurality of planes of reference, to thereby monitor movement in three-dimensions. At step 205, if control circuit C determines the concurrent presence of output signals from the motion sensors 51–53 indicative of movement of the personal computer 2 and output signals from the telephone line monitoring apparatus 8 indicative of loss of bias voltage on the telephone line TL, then a determination is made that possible unauthorized movement of personal computer 2 is taking place.

When this determination is made, processing advances to step 206 where an alarm indication is generated. In response to the alarm indication, control circuit C at step 207 also activates selected one(s) of at least one theft deterrence actions. The theft deterrent actions can include generating an audible alarm at step 208 using the audio output capability (not shown) of personal computer 2 to alert the user or thief that the unauthorized movement of the personal computer 2 has been detected. Optionally or additionally, control circuit C can turn on the personal computer 2 if it is not presently powered up and a message displayed at step 209 on display D to the user that an authorization code must be entered via keyboard K to terminate the theft deterrence actions. The power up step can be implemented by a mini-boot routine that quickly displays the prompt without proceeding through the normal boot sequence, which can be time consuming. If the user enters the proper response to the security system prompt, such as a validation password, as determined at step 210, then the alarm indication is disabled at step 211 and movement of personal computer 2 is enabled. The disabling of the personal computer security system 1 continues until the system is "reset" to a new "permanent" location. Thus, at step 213, the reinitialization of the security system 1 is activated when the user reinstalls the personal computer 2 and processing then advances to step 201. Absent this step (213) the alarm routine would continue to cycle as the personal computer 2 is being moved by the authorized user.

If the user fails to enter an appropriate response to this query within a predetermined length of time, as determined at step 210, the next successive one of the theft deterrence actions is initiated. The successive action taken at step 212 can be erasing or encrypting the personal computer memory M to safeguard the data contained therein from the unauthorized user. Since the security system 1 is battery powered and located within the personal computer 2, it is difficult for someone to access the security system 1 prior to this action taking place. To provide maximum effectiveness, the encryption/erasure of the directory information written on the hard drive M can occur prior to the encryption/erasure of the remaining sectors of the hard drive M. The erasure of memory, if this option is selected, can be effected by the reformatting of the hard drive M. Other punitive measures can be envisioned to render the memory M or even the CPU of the personal computer 2 inoperable to thereby make the theft of the personal computer 2 an exercise in futility.

Summary

Figure 2:
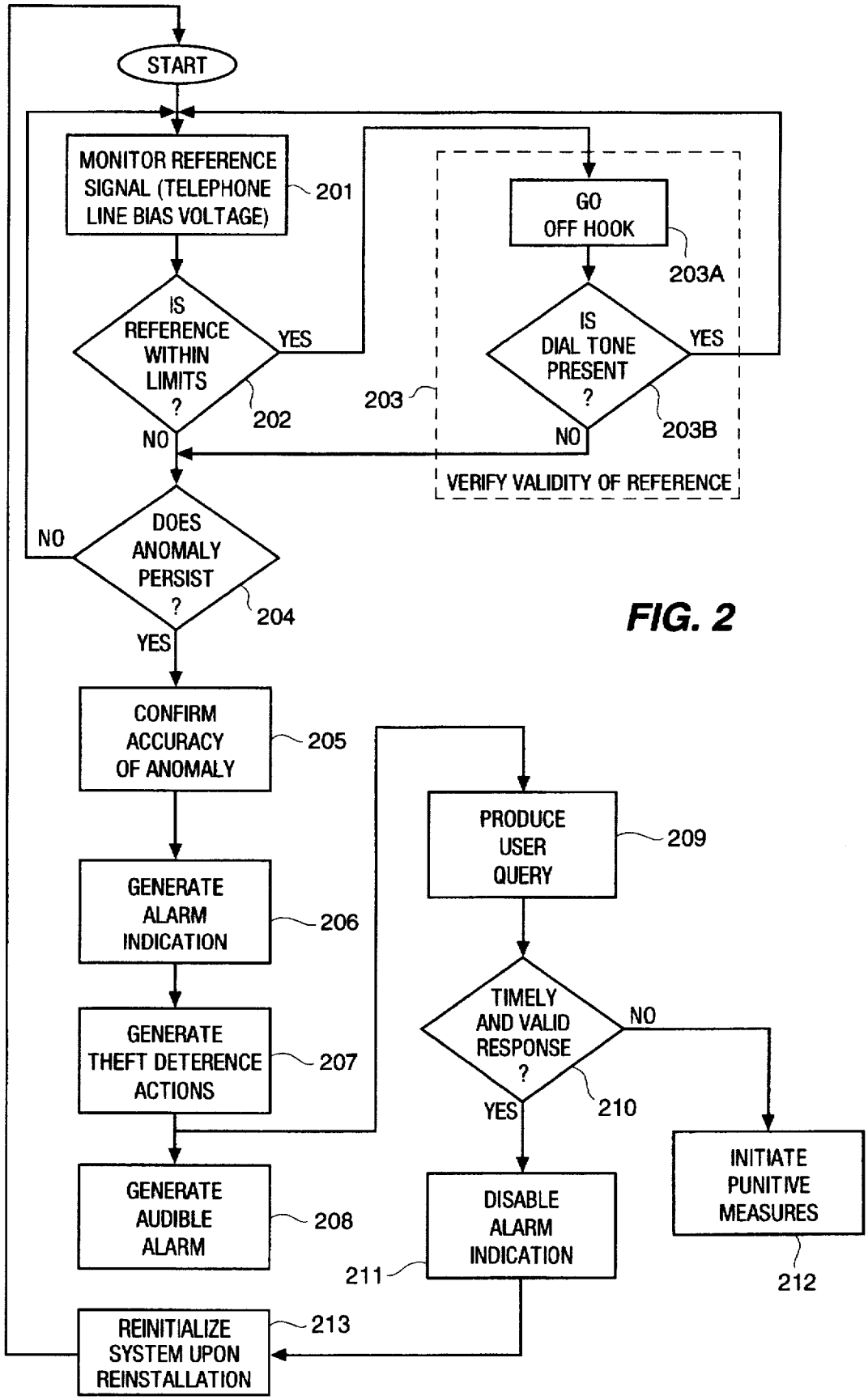
FIG. 2 illustrates in flow diagram form the operational steps taken by the security apparatus to perform its function.

While a preferred embodiment of the invention has been disclosed herein, it is expected that variations of the specific teachings contained herein can be devised, which conceptually correspond to the intent of the teachings of this description, as reflected in the claims appended hereto. In particular, the use of the telephone line is a convenient reference source, but other reference sources may also be suitably effective, such as connection to a local area network, cellular network, source of AC power, etc. Likewise, numerous theft deterrent actions can be implemented and those described herein are simply illustrative of simple and effective ones. The steps described in FIG. 2 are illustrative and the number and complexity of the described actions are expected to be selected as a function of the power available from the battery 3 as well as the time required to implement the steps. A rapid response is preferred, yet the speed of action must be balanced against the consequences of an incorrect determination.

I claim:

1. Apparatus for providing security to prevent unauthorized removal of a personal computer from a location at which the personal computer is resident, comprising:

means for monitoring the presence of a reference signal produced by a substantially immutable reference signal source;

means for monitoring the presence of a reference signal produced by a substantially immutable reference signal source;

means, responsive to said monitoring means determining a variance of said reference signal in excess of a predetermined threshold, for generating an alarm indicating unauthorized movement of said personal computer; and means, responsive to said alarm indication, for activating at least one theft deterrence action.

2. The apparatus of claim 1 wherein said monitoring means comprises:

means for determining the presence of a predetermined voltage present on a telephone line to which said personal computer is connected.

3. The apparatus of claim 2 wherein said monitoring means further comprises:

means for periodically validating said predetermined voltage by generating an off-hook condition on said telephone line to elicit dial tone from telephone company equipment serving said telephone line.

4. The apparatus of claim 1 wherein said monitoring means comprises:

at least one motion sensor mounted within said personal computer for generating a signal indicative of absence of motion in a predetermined plane of reference in excess of a predetermined amount.

5. The apparatus of claim 1 wherein said monitoring means comprises:

means for determining the presence of a predetermined voltage present on a telephone line to which said personal computer is connected;

at least one motion sensor mounted within said personal computer for generating a signal indicative of absence of motion in a predetermined plane of reference in excess of a predetermined amount.

6. The apparatus of claim 5 wherein said alarm generating means comprises:

means for verifying a concurrent determined absence of said reference signal for greater than a predetermined period of time from both said predetermined voltage determining means and said at least one motion sensor.

7. The apparatus of claim 1 wherein said activating means comprises:

means for producing an audible alarm.

8. The apparatus of claim 1 wherein said activating means comprises:

means for activating said personal computer to display a query to a user; and means, responsive to a user failing to input a valid response to said query, for producing an audible alarm.

9. The apparatus of claim 8 wherein said activating means further comprises:

means for disabling access to data stored in said personal computer.

10. The apparatus of claim 9 wherein said disabling access means comprises:

means for reformatting memory resident in said personal computer.

11. A method for providing security to prevent unauthorized removal of a personal computer from a location at which the personal computer is resident, comprising the steps of:

monitoring the presence of a reference signal produced by a substantially immutable reference signal source;

generating, in response to determination of variance of said reference signal in excess of a predetermined threshold, an alarm indicating unauthorized movement of said personal computer; and activating, in response to said alarm indication, at least one theft deterrence action.

12. The method of claim 11 wherein said step of monitoring comprises:

determining the presence of a predetermined voltage present on a telephone line to which said personal computer is connected.

13. The method of claim 12 wherein said step of monitoring further comprises:

periodically validating said predetermined voltage by generating an off-hook condition on said telephone line to elicit dial tone from telephone company equipment serving said telephone line.

14. The method of claim 11 wherein said step of monitoring comprises:

using at least one motion sensor mounted within said personal computer to generate a signal indicative of absence of motion in a predetermined plane of reference in excess of a predetermined amount.

15. The method of claim 11 wherein said step of monitoring comprises:

determining the presence of a predetermined voltage present on a telephone line to which said personal computer is connected;

using at least one motion sensor mounted within said personal computer to generate a signal indicative of absence of motion in a predetermined plane of reference in excess of a predetermined amount.

16. The method of claim 15 wherein said step of alarm generating comprises:

verifying a concurrent determined absence of said reference signal for greater than a predetermined period of time from both said step of predetermined voltage determining and said at least one motion sensor.

17. The method of claim 11 wherein said step of activating comprises:

producing an audible alarm.

18. The method of claim 11 wherein said step of activating comprises:

activating said personal computer to display a query to a user; and producing, in response to a user failing to input a valid response to said query, an audible alarm.

19. The method of claim 18 wherein said step of activating further comprises:

disabling access to data stored in said personal computer.

20. The method of claim 19 wherein said step of disabling access comprises:

reformatting memory resident in said personal computer.

* * * * *